United States Patent [19]

Lersten et al.

[11] Patent Number: 4,610,208

[45] Date of Patent: Sep. 9, 1986

[54] VIBRATING GRATE IN A HEATING BOILER

[75] Inventors: Bjarne Lersten; Kjell Svensson, both of Kil, Sweden

[73] Assignee: Kils el Ab, Karlstad, Sweden

[21] Appl. No.: 704,311

[22] PCT Filed: Apr. 16, 1984

[86] PCT No.: PCT/SE84/00145

§ 371 Date: Dec. 10, 1984

§ 102(e) Date: Dec. 10, 1984

[87] PCT Pub. No.: WO84/04374

PCT Pub. Date: Nov. 8, 1984

[30] Foreign Application Priority Data

Apr. 26, 1983 [SE] Sweden ..... 8302335

[51] Int. Cl.[4] ..... F23G 5/30

[52] U.S. Cl. ..... 110/244; 110/249; 110/258; 110/268; 122/4 D; 126/155

[58] Field of Search ..... 122/4 D, 15, 22; 126/155; 110/234, 243, 244, 245, 249, 251, 254, 258–267, 268, 286, 287, 288, 300, 328, 101 R, 102, 104 R

[56] References Cited

U.S. PATENT DOCUMENTS 4,007,697 2/1977 Prill ..... 110/288
4,250,818 2/1981 Sigg ..... 110/258 X
4,459,921 7/1984 Unger ..... 110/244 X
4,470,359 9/1984 Smith ..... 122/15 X

FOREIGN PATENT DOCUMENTS 41860 12/1981 European Pat. Off. .
48089 3/1982 European Pat. Off. .
136214 6/1952 Sweden .
168460 9/1959 Sweden .

*Primary Examiner*—Albert J. Makay
*Assistant Examiner*—Steven E. Warner

[57] ABSTRACT

According to the invention it is suggested that, in a heating boiler with a vibrating grate (3), a supply pipe (6) from which fuel material in particle form, in particular pellets, is supplied to the grate, is mechanically connected to the grate (3) and arranged to freely support the grate, which is thereby freely suspended in the combustion chamber without contact with the bottom and walls of the combustion chamber. A vibrating means (19) is also mechanically connected to the supply pipe (6) and arranged to produce a rectilinear movement and to function as drive source to feed the fuel particles to the grate via the supply pipe (6). The vibrating means gives the fuel particles a toss movement obliquely upwards and forwards in the supply pipe and on the grate whereby the fuel particles move onto the grate and towards the end of the grate opposite the supply pipe (6).

6 Claims, 2 Drawing Figures

VIBRATING GRATE IN A HEATING BOILER

The present invention relates to a means in a heating boiler having a grate onto which fuel material is supplied in particle form from a supply pipe, a vibrating means being arranged to cause the grate to vibrate in order to give the fuel particles a toss movement up from the grate depending on the oscillation effect produced by the vibrating means.

In recent years the use of biomass for energy purposes has increased considerably. The biomass is converted to a fuel in suitable solid form, such as pellets or brickettes. Fuel pellets are produced from waste-paper, raw timber products, peat, straw and mixtures of these materials, etc. and, due to their low moisture content (usually below 15%) and high density, they are intended to enable high hearth temperatures when burnt in a heating boiler. However, it has been found that slag is formed due to too high a combustion temperature, in turn caused by too great and rapid supply of air. Thus, when wood pellets were burned intermittently on a grate, this had to be cleared from slag at regular intervals as it became more and more difficult for the primary air to reach the hearth and partially combusted, charcoal pellets had collected on the inner part of the grate.

Fuel pellets have many advantages and valuable properties and there is therefore a great need to solve the problems mentioned above in a satisfactory manner.

EP-A2 0 048 089 describes a heating boiler for the combustion of solid fuel on a grate which is not freely suspended in the combustion chamber but instead rests on a pipe-connection at the bottom of the combustion chamber. A vibrator means is arranged to give the grate a vertical vibratory movement and the grate must therefore be inclined downwards so that the fuel can be spread while special measures must be taken to retard spreading of the fuel on the inclined grate. The supply means is not connected with the grate or with the vibrator either.

EP-A2 0 041 860 describes a heating boiler at least as complicated in its design as that according to the specification discussed above. The grate is horizontal and the vibrator arranged so that the fuel particles resting on the grate are not tossed up but moved forwards without leaving the grate. The forward movement of the fuel particles is caused by the particles themselves pushing against each other at the filling point, and thus being forced forward. This is facilitated by the vibratory grate.

Swedish patent specification 136 214 describes a vibratory grate for a combustion installation, which may have a supply funnel with inclined bottom plate connected to the grate. The fuel supply is regulated by adjusting an appropriate inclination on the bottom plate. The fuel supply cannot therefore be regulated simply by altering the oscillation frequency of the vibrator. Neither is the grate freely suspended in the combustion chamber. The vibrator is arranged in the combustion chamber and is connected to the grate, not to the bottom plate of the supply funnel. Neither is the vibrator in any of the described embodiments arranged to impart a tossing movement to the fuel particles. Instead these will only slide along the bottom plate as a coherent bed. The vibrator is not arranged to function as drive source to supply fuel particles to the grate via a supply pipe. First of all, there is no such supply pipe in the known means, secondly the vibrator does not cause the fuel particles to be tossed obliquely upwards-forwards, thirdly the bottom plate is inclined to enable the supply of fuel due to a falling effect, and fourthly the bottom plate is so arranged that, due to vibration, it influences the fuel particles in the funnel so that they fall down and slide along the inclined bottom plate.

Swedish patent specification 168 460 relates to a method of feeding fuel along on a vibratory grate with inclined grate surface, while the amplitude is kept constant. No statement is given about free suspension of the grate.

U.S. Patent specification No. 4,250,818 describes a vibrating combustion bed which is not freely suspended in a combustion chamber.

A primary object of the present invention is to solve the problems mentioned above in particular in the burning of pellets and similar fuel material in a heating boiler and thus considerably improve the efficiency of the heating boiler by creating conditions in order to obtain good and uniform combustion and high hearth temperature without the pellets and the combusted material becoming bonded together to a slag which in turn gradually throttles the supply of primary air to the hearth.

This is achieved according to the present invention which is substantially characterised in that the supply pipe is mechanically connected to the grate and arranged to freely support the grate, which is thus freely suspended in the combustion chamber without contact with the bottom or walls of the combustion chamber, and that the vibrating means is mechanically connected to the supply pipe and arranged to produce a rectilinear reciprocal movement as well as functioning as drive source to feed the fuel particles to the grate via the supply pipe, the vibrating means also being arranged to continuously give the fuel particles a toss movement obliquely upwards and forwards in the supply pipe and on the grate, whereby the fuel particles move onto the grate and towards the end of the grate opposite the supply pipe.

Preferred embodiments of the invention appear from the following claims.

By having grate and supply pipe built together, and journalled in the manner described, and influenced by a common vibrating means which is mechanically connected to the supply pipe, i.e. located outside the hearth, a simple additional unit is obtained for simple rebuilding of conventional heating boilers and an improved efficiency. The rectilinear movement described by the vibrating means is transmitted directly to the supply pipe and the grate so that the fuel particles are constantly hit and will form a toss movement obliqeuely upwards-forwards in an irregular pattern. Since the fuel particles are in motion the whole time they will hit against each other and against the grate so that combusted material on the surfaces of the particles is removed therefrom and new material is exposed fdr continued combustion. Neither do the fuel particles have any chance of becoming sintered together or forming slag since they are in constant movement on the grate. They do not, therefore, form a compact bed. In experiments using pellets in the means according to the invention the heating boiler has been found to be considerably more efficient in that a satisfactory and uniform combustion and high hearth temperature can be maintained in a surprising manner, without pellets and the combusted material being bound together to slag. A very small amount of ash is obtained as the only waste product.

The invention will be described further with reference to the accompanying drawings.

Figure 1:
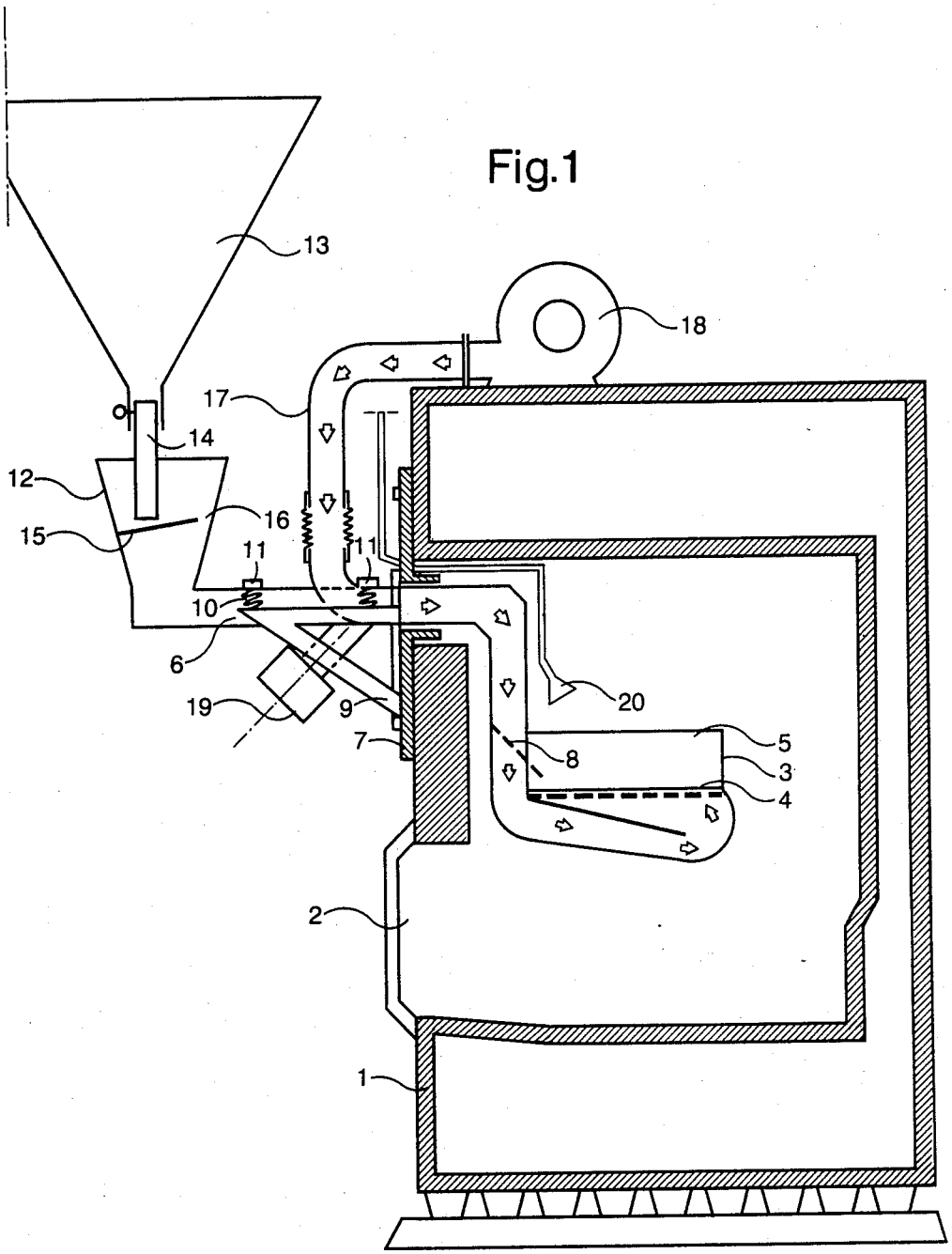
FIG. 1 shows schematically a heating boiler in section which is provided with a means according to the present invention.
Figure 2:
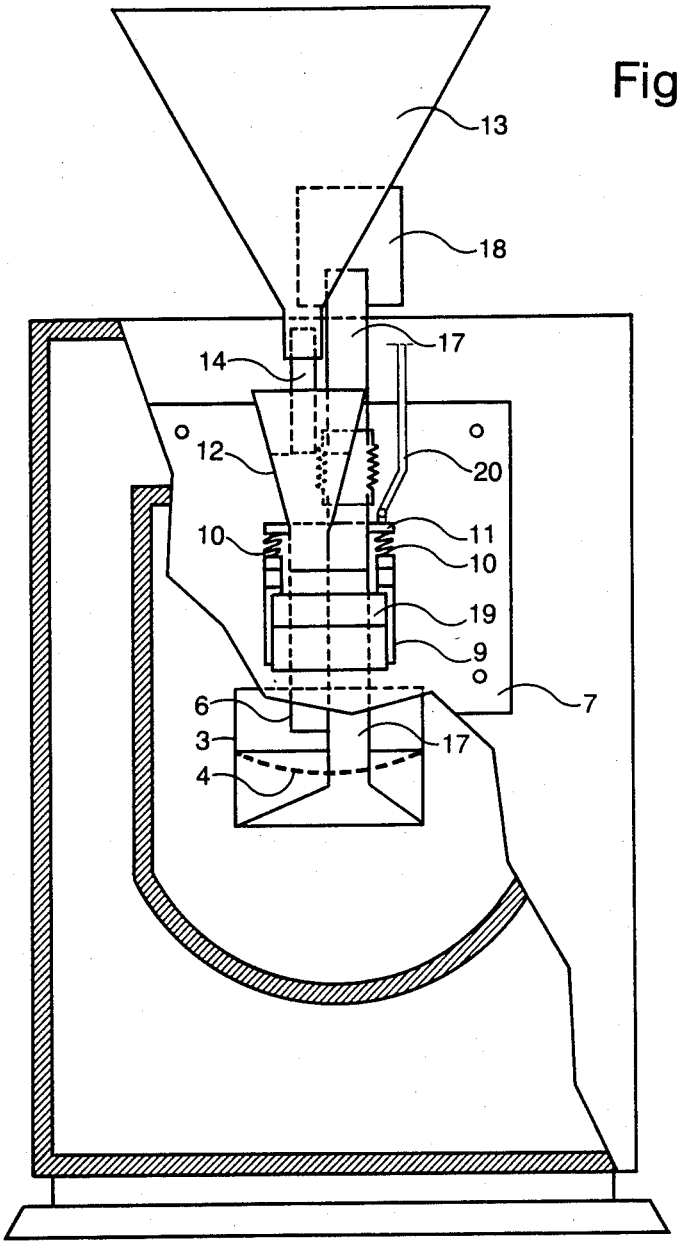
FIG. 2 shows the heating boiler according to FIG. 1 seen from the front with certain parts removed.

The drawings show schematically a heating boiler 1 which may be of conventional type. The heating boiler has a combustion chamber 2 into which the fuel material is introduced and combusted. The flue gases are withdrawn through a flue-gas pipe in known manner.

The heating boiler is equipped with a means according to the present invention which, in the embodiment shown, comprises a grate 3 located in the combustion chamber, said grate having a bottom 4 and surrounding side walls 5. The grate bottom is provided with through-holes or openings permitting air to flow through the grate in direction from below. The grate is arranged horizontally but may in certain cases be upwardly inclined in order to reduce the speed at which the particles move.

The grate 3 is supported by supporting means permitting it to be brought ipto oscillation at a suitable frequency by means of a vibrating means so that the fuel material, which is in piece or particle form, is brought into a toss movement obliquely up from the bottom 4 of the grate in forward direction.

The fuel material is supplied into the combustion chamber 2 through a supply pipe 6 which in the embodiment shown simultaneously serves as a part of the supporting means for supporting the grate which is thereby freely suspended in the combustion chamber without having any contact with the bottom or walls of the combustion chamber. A horizontal portion of the supply pipe 6 is passed through an aperture in a vertical door 7 which is detachably mounted to the front of the heating boiler. The supply pipe terminates in the combustion chamber with a vertical portion having an inclined guide plate 8 which ends above the bottom of the grate so that the fuel material can fall freely onto the grate.

Two brackets 9 are secured to the front door 7 which, via springs 10, support two cross-stays 11 attached to the supply pipe 6. The brackets 9, springs 10 and cross-stays 11, together with the supply pipe 6, form said supporting means for supporting the grate 3 such that this can be brought into rectilinear oscillation as will be described below. In other words, the grate 3 and supply pipe 6 are springingly or resiliently suspended at the front door 7 via the cross-stays 11 and brackets 9, and the springs 10 connecting the cross-stays 11 and brackets 9.

The supply pipe 6 has a hopper 12 supplied with fuel material from a store 13 which may consist of a separately suspended funnel immediately above the hopper 12 as shown in the drawings, or a silo or the like having suitable feeding means connected to the supply pipe 6. The funnel 13 has a mouth pipe 14, vertically adjustable to cooperate with an inclined plate 15 below, which is arranged in the hopper 12 to regulate the feeding rate of the fuel material. The rearwardly inclined plate 15 defines a gap 16 with the opposite wall of the hopper. The size of this gap 16 may be adjustable if desired, to offer an additional possibility of adjusting the correct feeding rate of the fuel material. Said control means in the form of the mouth pipe 14 and gap 16, can suitably be controlled and adjusted by one or more other functions of the heating boiler and possibly by external factors.

In the shown embodiment, a pipe 17 for the supply of air is passed through the front door 7, parallel to the supply pipe 6, the air-supply pipe 17 being connected to a fan motor 18 which can be started when desired to forcedly blow in primary air, for instance for continuous operation or when the heating boiler starts and for a suitable period thereafter. The air-supply pipe extends below the grate 3 and ends at the inner end portion of the grate and below the bottom 4 of the grate, whereby air for the combustion flows in a favorable manner in direction to the place for the supplying of the fuel material.

A vibrating means 19 is arranged below the supply pipe 6 and in direct mechanical connection therewith. The vibrating means is arranged to bring the supply pipe 6 and thus also the grate 3 which is rigidly connected to the supply pipe by means of welding or rivet or screw joints, for instance, into oscillation or reciprocal movement with a suitable frequency and amplitude, whereby the oscillating movement is transmitted from the outer end of the supply pipe comprising the hopper 12, to the inner end of the grate. The fuel material in particle form entering the hopper 12 will thus be fed forward through the supply pipe 6 and further out onto and across the grate where it is gradually combusted. The fuel particles thus acquire a toss movement such that they the whole time are moved up from the support, i.e. the bottom of the supply pipe and the bottom 4 of the grate, and forwards in relation to the support, in a manner particularly conducive to the combustion. Since the fuel particles are constantly in motion, they will hit against each other and against the grate so that combusted material is removed from the particles and new material exposed for the continued combustion. Furthermore, the particles have no chance of sintering together or of forming slag since they are in constant movement on the grate.

The flow of the fuel material is determined by the frequency and oscillatory effect of the vibrating means. The oscillation amplitude can be regulated steplessly. Increased oscillation amplitude thus means that the fuel particles are tossed up in a higher path in relation to the grate.

If desired, the movement course of the fuel particles can be improved still further by directing the air for the combustion in below the grate such that the air flows up through the apertures in the grate as in the embodiment shown schematically. An excess of air normal for the combustion is thus utilized. If desired, the air flow through the grate can be further increased by feeding back some of the flue-gas leaving, whereby this portion of flue-gas is mixed with a quantity of air suitably adjusted for the combustion (including said excess). By directing the air-flow in the manner described, both ashes and small pieces of the fuel particles are prevented from falling down through the grate. Such small particles remain when most of the fuel particles have been combusted and have a size that is smaller than the appertures or openings in the grate.

Any known vibrating means which provides a rectilinear oscillatory movement can be used to effect vibration of the grate and supply pipe and may comprise magnet vibrator, unbalanced motors or mechanical means such as crank and excenter. According to a preferred embodiment of the invention a magnet vibrator is used, the oscillations being produced by an electromagnet supplied with alternating current. One half-period of the supply voltage is normally cut off by means of a uni-directional rectifier in order to obtain a lower periodicity, e.g. 3000 oscillations per minute. An advantage of the magnet vibrator is that it functions extremely reliably. Furthermore, the flow of material can be controlled and regulated steplessly during operation since an alteration in the control signal results practically instantaneously in a corresponding alteration in the flow of material. The magnet vibrator is mounted so that its centre line forms an acute angle with the direction of transport of the fuel material, as can be seen from the drawings, thus setting the conveyor, i.e. the supply pipe 6 and grate 3, in rectilinear oscillation, provided the grate supply, pipe and magnet vibrator are correctly balanced in relation to each other and the journalling points. Said acute angle between the centre line (the direction of vibration) of the vibrating means and the direction of transport of the fuel material may be varied depending on the desired toss angle (corresponding to said acute angle) of the fuel material. A suitable range of the acute angle is about 25°–40°, the preferred range being 30°–35°. The vibrating means is suitably adjustable so that the direction of vibration and thereby the acute angle and toss angle may be amended to values desired.

In accordance with the invention the magnet vibrator or other vibrating means has the double function to serve as drive source to feed the fuel particles to the grate and also to set the grate in oscillations which result in that the fuel particles are brought in a toss movement obliquely upwards so that they move into the grate towards its far end at the same time as they are relieved from burnt material by hitting against each other and against the grate, thus essentially improving the combustion and increasing the efficiency of the heating boiler. The supply of the primary air is preferably carried out by forced blowing by means of the fan motor 18, ensuring an uniform and complete combustion at the same time as the fuel particles will be carried and further tossed around by the air flowing through the grate when they are hit by the air jets. The ash will accompany the flue-gas upwards and then be collected at the bottom of the combustion chamber. Secondary air may be added at a point above the grate, particularly if the fuel particles contain volatile material which would otherwise disappear without being burnt. An ignition device 20 is preferably arranged in the vicinity of the grate in order to ignite the fuel material when the heating boiler is started. When the correct boiler temperature has been reached the supply of fuel particles is reduced by control means to zero or to such a low level that maintenance combustion can be maintained in the grate until the boiler temperature has fallen and a signal is again given for full combustion.

If considered suitable, a net or the like may be arranged on the roof of the grate to prevent fuel particles from being carried outside the grate.

The means according to the invention has been developed with the problem of burning pellets particularly in mind. However, it offers valuable advantages when burning other fuel materials in particle form and should not therefore be considered to be limited to pellets.

The means according to the invention comprising grate and vibrating means and supply pipe, i.e. grate and supply pipe built together and journalled in the manner described and actuated by a common vibrator, forms a simple additional unit for easy rebuilding of conventional heating boilers to which feeding means are connected from an adjacent stock of pellets.

We claim:

1. A means in a heating boiler having a grate onto which fuel material is supplied in particle form from a supply pipe, a vibrating means being arranged to cause the grate to vibrate in order to give the fuel particles a toss movement up from the grate depending on the oscillation effect produced by the vibrating means said supply pipe being mechanically connected to the grate and arranged to freely support the grate, which is thus freely suspended in the combustion chamber without contact with the bottom or walls of the combustion chamber, said vibrating means being mechanically connected to the supply pipe and arranged to produce a rectilinear movement as well as functioning as a drive source to feed the fuel particles to the grate via the supply pipe, said vibrating means being additionally arranged to continuously impart to the fuel particles a toss movement obliquely upwards and forwards in the supply pipe and on the grate whereby the fuel particles move onto the grate and towards the end of the grate opposite the supply pipe, said supply pipe being resiliently suspended on a front door of the heating boiler by means of cross-stays secured to the supply pipe, brackets secured to the front door, and springs arranged between the cross-stays and brackets.

2. A means according to claim 1, wherein a pipe for gas glow is connected to the lower side of the grate to direct a gas flow up through the grate, said pipe preferably being provided with a fan motor for forced supply of air to the combustion point.

3. A means in a heating boiler having a grate onto which fuel material is supplied in particle form from a supply pipe, a vibrating means being arranged to cause the grate to vibrate in order to give the fuel particles a toss movement up from the grate depending on the oscillation effect produced by the vibrating means, said supply pipe being mechanically connected to the grate and arranged to freely support the grate, which is thus freely suspended in the combustion chamber without contact with the bottom or walls of the combustion chamber, said vibrating means being mechanically connected to the supply pipe and arranged to produce a rectilinear movement as well as functioning as a drive source to feed the fuel particles to the grate via the supply pipe, said vibrating means being additionally arranged to continuously impart to the fuel particles a toss movement obliquely upwards and forwards in the supply pipe and on the grate whereby the fuel particles move onto the grate and towards the end of the grate opposite the supply pipe, said vibrating means being mounted at the supply pipe such that its center line forms an acute angle with the direction of transport of fuel material.

4. A means according to claim 3, wherein said acute angle is about 25°–40°.

5. A means according to claim 4 or 3, wherein said acute angle is adjustable by adjusting the vibrating means.

6. A means according to claim 3, wherein said acute angle is about 30°–35°.

* * * * *